United States Patent [19]

Weigel et al.

[11] 4,049,445

[45] Sept. 20, 1977

[54] METHOD FOR THERMAL TREATMENT OF NICKEL ORE

[75] Inventors: Horst Weigel, Cologne, Germany; Anton Spitz, deceased, late of Cologne, Germany, by Barbara Wilhelmine Spitz nee Schürmann, legal representative

[73] Assignee: Klockner-Humboldt-Deutz Aktiengesellschaft, Germany

[21] Appl. No.: 629,321

[22] Filed: Nov. 6, 1975

[30] Foreign Application Priority Data

Nov. 12, 1974 Germany ..... 2453564

[51] Int. Cl.[2] ..... C22B 23/02

[52] U.S. Cl. ..... 75/82; 75/36

[58] Field of Search ..... 75/82, 26, 36

[56] References Cited

U.S. PATENT DOCUMENTS 3,140,168 7/1964 Halley ..... 75/26

*Primary Examiner*—Peter D. Rosenberg

*Attorney, Agent, or Firm*—Hill, Gross, Simpson, Van Santen, Steadman, Chiara & Simpson

[57] ABSTRACT

A method and mechanism for thermally processing lateritic nickel ore wherein the ore is fed through a seal, fed to a series of preheater cyclones arranged to discharge to a burner chamber with a tangential burner and the burner chamber is connected to discharge to a reduction chamber which is fed reduction gases through a water cooled supporting grate, and the still combustible reduction gases passed upwardly to the burner chamber and then through an after burner chamber whereupon the gases enter the preheater chamber to supply heat for preheating the ore to reduction temperature.

9 Claims, 3 Drawing Figures

METHOD FOR THERMAL TREATMENT OF NICKEL ORE

BACKGROUND OF THE INVENTION

The invention relates to a method and mechanism for the thermal treatment of ore, and particularly for reducing and calcining lateritic nickel ore wherein the nickel ore is preheated by a stream of burning exhaust reduction gases to preheat the ore to reduction temperature.

Lateritic nickel ores occur as oxide ores, in which the nickel is dispersed through limonite, and silicate ores, in which the nickel occurs in a hydrated magnesium silicate.

It has been known in the reduction process for calcining lateritic nickel ore to use carbon monoxide and hydrogen at temperatures up to 800° C. It has also heretofore been known to use kilns with overlying beds or multiple story furnaces with uncooled rabble arms. In this type of construction heretofore used, only small quantities of lateritic nickel ore may be given reduction treatment. The multiple story furnaces for larger charges have air-cooled rabble arms, and because of the possible uncontrolled air inlet, the danger of explosion exists and, therefore, this type of device is not suitable for the processing of nickel ore. Further, the processes do not make optimum use of the reduction gases. That is, when hydrogen is used, for example, as a reducing gas, the energy contained in the excess gas is disregarded.

A basic object of the invention is to improve upon methods and structures heretofore available while avoiding disadvantages such as those referred to above and providing a device and a method capable of a greater capacity and greater output.

In accordance with the principles of the present invention, the nickel ore is preheated to reduction temperature by an exhaust gas stream which is intermixed with air by swirling the stream through the supply of gas in a preheating zone. A strong reducing gas such as hydrogen is preferred, and after the hydrogen has been exposed to the preheated ore in a reduction zone, the still combustible hydrogen gas is burned obtaining additional heat from it, and this heat energy is used for preheating the nickel ore prior to its entering the reduction zone. The thermal treatment of the lateritic nickel ore takes place in a gastight system increasing its effectiveness and reducing the possibility of explosions.

An advantage obtained with the present invention is in obtaining an intensive reduction by the direct contact of the reducing gas with the nickel ore in the preheating stage so that the ore is uniformly and thoroughly heated to reduction temperature. A further advantage of the features of the present invention is that the energy contained in the reduction gas in excess of that utilized in the reduction process is utilized in combustion, and these combustible gases are used for preheating the nickel ore thereby obtaining a more efficient system saving in the cost of energy and increasing the capacity of an operative unit. As the reduction gases, such as hydrogen, are passed from the reduction zone, they are burned, and the heat or thermal energy being obtained from the reduction gases is mixed with the incoming ore in the closed system for a preheating operation. The reducing gases are heated in a burner chamber by being mixed with a tangentially swirling incoming burner which is also fed with the preheated ore so that the ore again contacts the reducing gases as they are being burned by the burner. The utilization of the heat contained in the reducing gases and by the burning gases of the burner is utilized by direct contact with the nickel ore through a series of preheating cyclones which are connected successively in series. This thermal treatment in the reduction zone, the burner zone, and the preheating zone is carried out in a gas-tight continuous system fed through a seal and discharged through a seal so that upon utilization of hydrogen in the reducing gas, no danger of explosion exists.

In accordance with a preferred embodiment, a reaction or reduction chamber into the which the reducing gas is fed discharges upwardly into a burner chamber, and in the burner chamber a burner discharges tangentially. The preheated ore is fed into the tangential burner so that a swirling intermixing occurs in the burner chamber. The reduction gas is initially fed into the reduction zone through a water cooled supporting grid or grate. A reduction or reaction chamber of this type for the treatment of finely grained material is disclosed in the German laid open specification No. 2,044,141. In the arrangement there disclosed, aluminum oxide is recrystallized and a reaction chamber is provided between a burner or a heated gas inlet with the surface of the whirling or turbulent layer following a wall which widens upwardly. The construction of the reaction chamber brings about a spatial separation of the cyclone turbulence produced by the heating gas and the turbulence layer coming up from the lower part of the reaction chamber. In that arrangement a mutual influencing between the cyclone turbulence and turbulence layer is prevented. It is made possible to arrange the reaction chamber so that optimum conditions are attained for the treatment of finely grained material in the turbulent cyclone and turbulent layer arrangement so that two reaction phases may be passed through by the material.

In the present arrangement an opening is formed through a constriction in the reaction chamber. The gases are introduced in the reaction chamber for the reduction process and then rise into the upper part of the reaction chamber and mix in the burning chamber with burning gases and combustion air. The reduction gases are then burned in the burner and continue to burn in an after burning chamber above the burner, and the thermal energy obtained from the reduction gases is then utilized in the preheating chamber.

In order to prevent the penetration of uncontrolled air and to prevent the danger of explosion, a gas sealed system is used, and a sealed material feed unit is utilized and a sealed material discharge unit is utilized. The process is thus basically a gas-tight arrangement so that no uncontrolled entry of air is possible.

The reducing gas, such as hydrogen, is fed in the reduction zone through a water cooled carrier grid or grate and whirls upwardly through the lateritic nickel ore lying above it and passing downwardly from the burner chamber. When the complete reduction has taken place, the finished material drops downwardly into a collection chamber below the grate, and is fed out through a gas-tight discharge mechanism such as a pressure feed worm conveyor. Pressure feed worm conveyors are used for the supply of ore and for the discharge of processed ore in that they provide a reliable operating seal, and by control of their speed of operation, a close control of the supply of material fed into the system can be attained.

Other objects, advantages and features will become more apparent, as will equivalent structures and methods which are intended to be covered herein, from the teaching of the principles of the invention in connection with the disclosure of the preferred embodiment set forth in the specification, claims and drawings, in which:

DRAWINGS

DESCRIPTION

Figure 1:
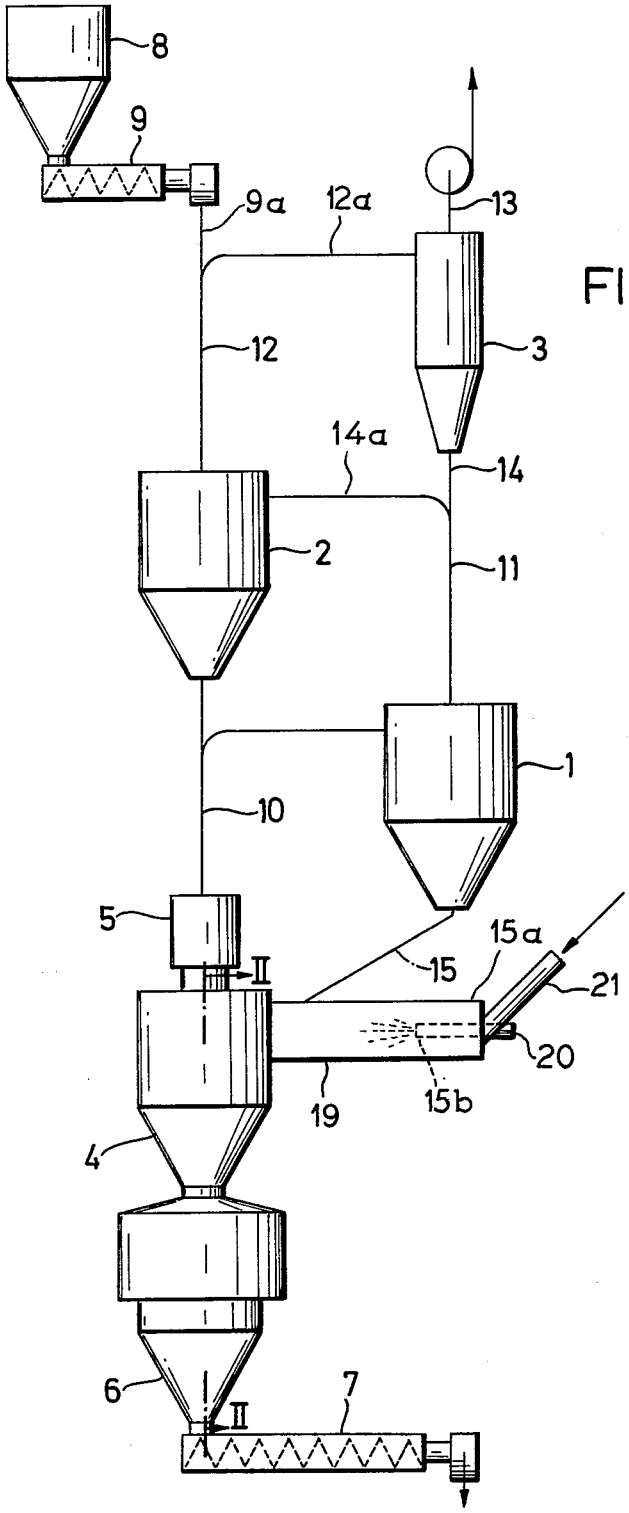
FIG. 1 is a schematic or diagrammatic illustration of a device constructed and operating in accordance with the principles of the present invention.

As illustrated in FIG. 1, the ore is first fed to a preheating zone which includes the preheating cyclones 1, 2 and 3. Heated gases for preheating the ore passing through the cyclones is obtained from an after burning chamber 5.

The ore is fed from a material supply hopper 8 which feeds downwardly to a pressure feed worm conveyor 9 which provides a sealed inlet for the preheating cyclones.

Preheating gases received from the after burning chamber 5 flow up through the conduit 10 into the first cyclone 1. These gases mix with ore which is fed downwardly from the discharge of the preheater cyclone 2, and the gases and ore are fed tangentially into the cyclone 1. The hot exhaust gases which have acted on the ore in the cyclone 1 pass upwardly through the conduit 11 to mix with ore passing down through the conduit 14 from the preheater cyclone 3, and pass tangentially into the inlet conduit **14*a* for the cyclone 2. The exhaust gases pass upwardly from the cyclone 2 along the conduit 12 and mix with the ore flowing down through the conduit 9*a* to pass along conduit 12*a* into the inlet of the cyclone 3. The continual flow of gases is aided by a blower 13 which draws the gases from the central outlet of the cyclone 3**.

The ore is fed from a suitable supply, not shown, to the ore hopper 8 which is suitably driven, and the speed of rotation of the feed auger 9 will control the rate and amount of ore fed into the system. The ore supply can, of course, be mechanically interrelated to the supply of reduction gases and the amount of combustible gas fed to the burner chamber.

When the material is fully preheated in the preheater zone, which comprises the three preheater cyclones 1, 2 and 3, it is discharged through the conduit 15 into the burner chamber 4. The burner chamber is circular in shape having a general cyclone shape with a tangential burner feed 19. Within the burner feed is a burner nozzle **15*b* which is fed with fuel through the line 20 and with a controlled amount of combustion supporting air through the line 21. The burner tube 19 receives the preheated ore, and the burning gases and ore are fet tangentially into the burner chamber 4. The burner chamber is mounted above the reaction chamber 6 which discharges the ore after the reaction process has been completed through a discharge auger 7. The reaction chamber 6 and the overhead burner chamber 4 are shown in greater detail in FIG. 2**.

Figures 2, 3:
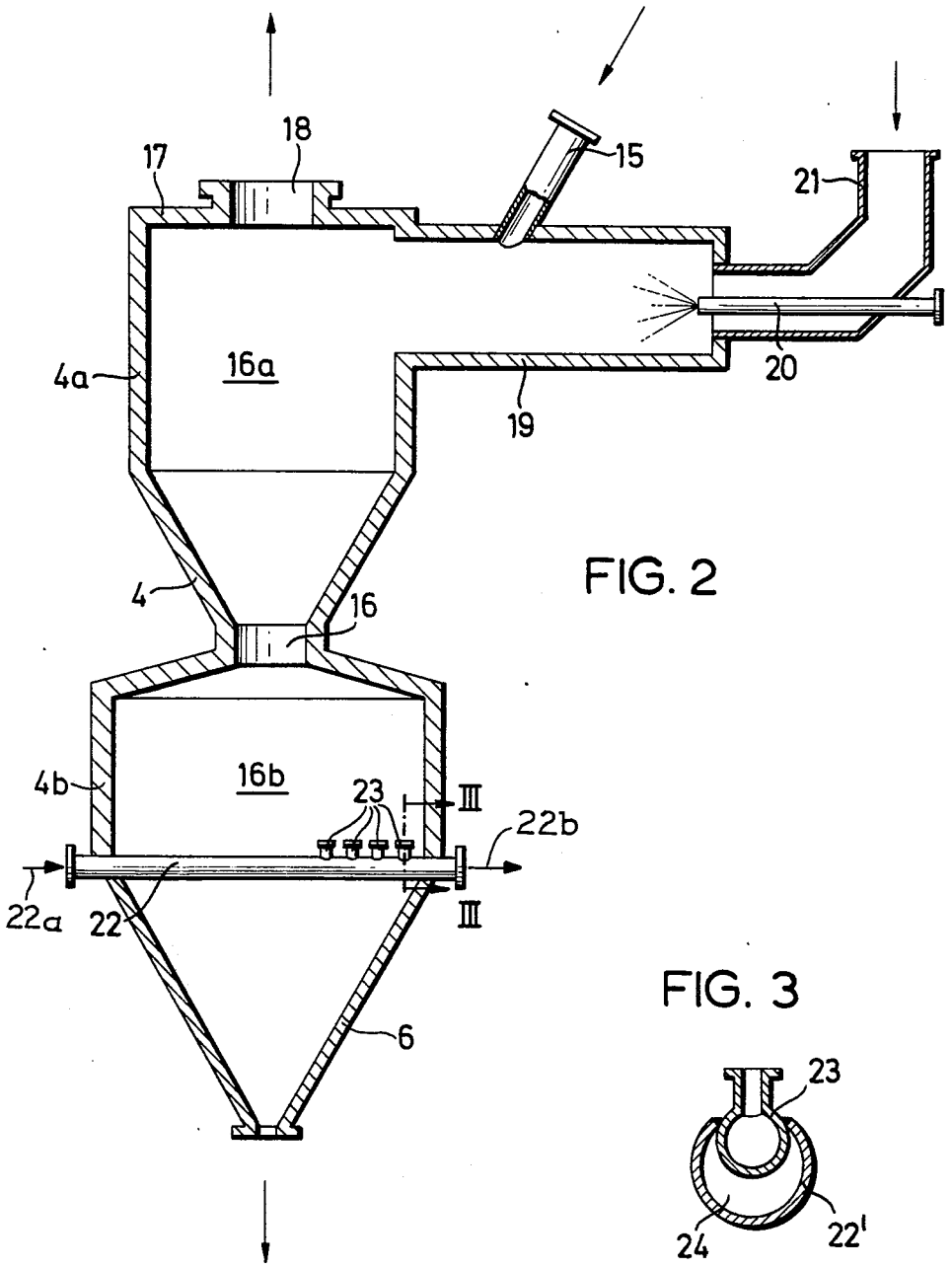
FIG. 2 is an enlarged cross-sectional view taken substantially along line II—II of FIG. 1.
FIG. 3 is an enlarged detailed sectional view taken substantially along line III—III of FIG. 2.

As illustrated in FIG. 2, the reaction vessel 4, 6, 19 consists of the lower reaction portion **4*b* and the upper burner portion 4*a*. At the top of the burner chamber is a ceiling or overhead 17 through which the preheater ore is supplied through the conduit 15. Centrally located relative to the burner chamber 16*a* is a gas passage opening 18 which leads upwardly to the after burning chamber shown at 5 in FIG. 1. The after burning chamber permits the heated reduction gases from the burning chamber 16*a*** to continue their combustion to free the maximum amount of thermal energy for use in the preheater chamber.

The burner chamber **16*a* receives the combustion gases tangentially which are supplied through the burner tube shown generally by the fuel supply line 20 and the air supply line 21**.

Inasmuch as the preheated ore is fed into the burner conduit 19, it first contacts the burning gases supplied from the burner 20 so that additional heat is furnished to the ore to bring it fully to reduction temperature. The ore at reduction temperature then flows tangentially into the burner chamber **16*a* and downwardly through the constriction passage 16 into the reduction chamber 16*b*. In the reduction or reaction chamber 16*b*, is located a water cooled grate 22 supplied with water by supply means shown schematically at 22*a* and 22*b*. Through the water cooled grate is fed a reducing gas, preferably hydrogen, which is emitted through hydrogen blower nozzles 23. The hydrogen whirls upwardly through the nickel ore which lies on the grate having been fed downwardly through the passage 16. The final stages of reduction take place on the grate inasmuch as the ore has been heated to reduction temperature and the hydrogen passes therethrough. When the reduction has taken place, the ore falls downwardly and is conveyed outwardly through the pressure feed worm 7 as shown in FIG. 1. The excess reduction gases rise upwardly through the passaage 16 into the burner portion or upper portion 16*a* of the reaction chamber and there mix with the hot burning gases from the gas conduit 19 and begin burning and complete their burning in the after burning chamber 5**. Thus, the thermal energy remaining in these still combustible hydrogen gases is utilized.

FIG. 3 illustrates somewhat schematically a carrier pipe 22' of the grate 22 which supplies the reduction gas. The carrier pipe has a blower nozzle 23 through which the hydrogen is emitted. The cooling water flows through the pipe in the lower chamber or cavity 24.

Thus, in operation the material is supplied from a hopper 8 down through a controlled sealed pressure worm feed 9 into the preheater zone including the preheater cyclones 1, 2 and 3. The preheated material is fed directly into a combustion conduit 19 having a burner 20 with controlled air 21 to bring the material to reduction temperature. The material flows tangentially into the upper portion of the reactor chamber, which is a burner chamber **16*a* and then downwardly to the lower portion 16*b* where it is supplied with reduction gases, such as hydrogen, through nozzles 23. The reaction process, when completed, drops the material down from the grate 22, and the reduction gases pass upwardly through the burner chamber 16*a* to be ignited and complete their burning in the after burner chamber 5** to pass upwardly to use their thermal energy through the preheater chambers.

Thus, we have provided an improved process and mechanism which meets the objectives and advantages set forth and is capable of continued economical and reliable operation on a commercial scale with improved efficiency and providing an improved, more uniform product.

We claim as our invention:

1. The method of thermally processing lateritic nickel ore which comprises:

preheating the ore in a preheating zone;

feeding the preheated ore to a heating zone and then to a reduction zone;

supplying a reducing gas to said reduction zone;

feeding the reducing gas from the reduction zone and a fuel/air mixture to said heating zone whereby the still combustible reduction gases are burned in direct contact with the ore and the temperature of the ore is raised by the hot gases to a selected reduction temperature; and conducting the hot, burned reduction gases and fuel-/air mixture to said preheating zone for preheating the ore.

2. The method of thermally processing lateritic nickel ore in accordance with the steps of claim 1:

wherein each zone is closed to surroundings in gas-tight fashion and the ore is fed to the preheating zone and from the reduction zone through gas-tight seals.

3. The method of thermally processing lateritic nickel ore in accordance with the steps of claim 1:

wherein the hot reduction gases from the heating zone are fed tangentially to mix with the ore in the preheating zone.

4. The method of thermally processing lateritic nickel ore in accordance with the steps of claim 1:

wherein the fuel/air mixture is supplied to the heating zone in a tangential direction relative to the entering reduction gases.

5. The method of thermally processing lateritic nickel ore in accordance with the steps of claim 1:

wherein the reduction gases are fed vertically upwardly from the reduction zone to the heating zone and the preheated ore is fed tangentially into the heating zone.

6. The method of thermally processing lateritic nickel ore in accordance with the steps of claim 1:

wherein the reduction gas is hydrogen.

7. The method of thermally processing lateritic nickel ore in accordance with the steps of claim 1:

wherein the ore is preheated and fed into the heating and reduction zones in a stream.

8. The method of thermally processing lateritic nickel ore in accordance with the steps of claim 1:

wherein the combustion of the reduction gas and the fuel/air mixture is completed in an after-burning zone interposed between the heating zone and the preheating zone.

9. A method for thermochemically treating nickel ore with a reduction gas, comprising the steps:

introducing the gas into a reduction zone;

passing said gas into a heating zone above said reduction zone through a passage and against a downward flow of said ore;

burning a combustible portion of said gas in said heating zone in the presence of free oxygen and in contact with said ore to bring the ore to a reduction temperature; and passing said gas in a hot exhaust stream against a downward flow of said ore in a preheating zone, for preheating said ore prior to entry of said ore into said heating zone.

* * * * *